US008727528B2

(12) United States Patent
Romano, Jr.

(10) Patent No.: US 8,727,528 B2
(45) Date of Patent: May 20, 2014

(54) GLOSSY RECORDING MEDIUM FOR INKJET PRINTING

(75) Inventor: Charles E. Romano, Jr., Wisconsin Rapids, WI (US)

(73) Assignee: Newpage Corporation, Miamisburg, OH (US)

( * ) Notice: Subject to any disclaimer, the term of this patent is extended or adjusted under 35 U.S.C. 154(b) by 121 days.

(21) Appl. No.: 13/397,943

(22) Filed: Feb. 16, 2012

(65) Prior Publication Data

US 2012/0212555 A1 Aug. 23, 2012

Related U.S. Application Data

(60) Provisional application No. 61/444,498, filed on Feb. 18, 2011, provisional application No. 61/470,810, filed on Apr. 1, 2011, provisional application No. 61/567,181, filed on Dec. 6, 2011.

(51) Int. Cl.
*B41J 3/407* (2006.01)
*C04B 16/00* (2006.01)
*B41M 5/52* (2006.01)

(52) U.S. Cl.
USPC ..... 347/106; 428/32.21; 106/505

(58) Field of Classification Search
None
See application file for complete search history.

(56) References Cited

U.S. PATENT DOCUMENTS

| | | | | |
|---|---|---|---|---|
| 1,941,001 | A | 12/1933 | Hansell | |
| 3,197,322 | A | 7/1965 | Maskal et al. | |
| 3,373,437 | A | 3/1968 | Sweet et al. | |
| 3,416,153 | A | 12/1968 | Hertz et al. | |
| 3,798,047 | A | 3/1974 | Delfosse | |
| 3,878,519 | A | 4/1975 | Eaton | |
| 4,346,387 | A | 8/1982 | Hertz | |
| 4,714,603 | A | 12/1987 | Vanderheiden | |
| 4,824,654 | A | 4/1989 | Ota et al. | |
| 5,120,365 | A | 6/1992 | Kogler | |
| 5,164,172 | A | 11/1992 | Katayama et al. | |
| 5,269,818 | A | 12/1993 | Kunesh et al. | |
| 5,296,002 | A | 3/1994 | Passaretti | |
| 5,320,897 | A * | 6/1994 | Kondo et al. | 428/32.36 |
| 5,332,564 | A | 7/1994 | Chapnerkar et al. | |
| 5,418,057 | A | 5/1995 | Kokiyoshi et al. | |
| 5,454,864 | A | 10/1995 | Whalen-Shaw | |
| 5,478,388 | A | 12/1995 | Gane et al. | |
| 5,676,746 | A | 10/1997 | Brown | |
| 5,731,034 | A | 3/1998 | Husband | |
| 5,846,382 | A | 12/1998 | Von Raven | |
| 5,861,209 | A | 1/1999 | Haskins et al. | |
| 5,879,442 | A | 3/1999 | Nishiguchi et al. | |
| 5,882,396 | A | 3/1999 | Hiorns | |
| 5,939,036 | A | 8/1999 | Porter et al. | |
| 6,071,336 | A | 6/2000 | Fairchild et al. | |
| 6,150,289 | A | 11/2000 | Chen et al. | |
| 6,156,286 | A | 12/2000 | Fortier et al. | |
| 6,207,258 | B1 | 3/2001 | Varnell | |
| 6,221,146 | B1 | 4/2001 | Fortier et al. | |
| 6,380,265 | B1 | 4/2002 | Pryor et al. | |
| 6,402,824 | B1 | 6/2002 | Freeman et al. | |
| 6,554,410 | B2 | 4/2003 | Jeanmaire et al. | |
| 6,630,229 | B1 | 10/2003 | Normington et al. | |
| RE38,301 | E | 11/2003 | Bleakley et al. | |
| 6,677,386 | B1 | 1/2004 | Giezen et al. | |
| 6,685,908 | B1 | 2/2004 | Yaniv | |
| 6,698,880 | B1 * | 3/2004 | Campbell et al. | 347/105 |
| 6,780,920 | B2 | 8/2004 | Chapman et al. | |
| 6,825,252 | B2 | 11/2004 | Helbling et al. | |
| 6,841,609 | B2 | 1/2005 | Chapman et al. | |
| 6,863,775 | B2 | 3/2005 | Bobsein et al. | |
| 6,921,430 | B2 | 7/2005 | Bloembergen et al. | |
| 7,014,893 | B2 | 3/2006 | Wicher et al. | |
| 7,285,586 | B2 | 10/2007 | Helbling et al. | |
| 7,351,278 | B2 * | 4/2008 | Jackson | 106/31.43 |
| 7,393,571 | B2 | 7/2008 | Chapman et al. | |
| 7,452,592 | B2 | 11/2008 | Cowton | |
| 7,553,395 | B2 | 6/2009 | Stoffel et al. | |
| 7,803,224 | B2 | 9/2010 | Schliesman et al. | |
| 8,092,873 | B2 | 1/2012 | Wang et al. | |
| 8,256,887 | B2 | 9/2012 | Zhou et al. | |
| 8,425,728 | B2 | 4/2013 | Zhou et al. | |

(Continued)

FOREIGN PATENT DOCUMENTS

| | | | |
|---|---|---|---|
| EP | 1114735 | A2 | 7/2001 |
| EP | 2196320 | | 6/2010 |
| JP | 55-51583 | | 4/1980 |
| WO | 03/031191 | | 4/2003 |
| WO | 03/031191 | A2 | 4/2003 |
| WO | 03/031191 | A3 | 4/2003 |
| WO | 2004/061014 | | 7/2004 |
| WO | 2006/116878 | | 11/2006 |
| WO | 2007/112013 | | 10/2007 |
| WO | 2009/095697 | | 8/2009 |
| WO | 2009/110910 | | 9/2009 |
| WO | 2010/065750 | | 6/2010 |
| WO | 2010/114560 | | 10/2010 |
| WO | 2011/019866 | | 2/2011 |
| WO | 2011/026070 | | 3/2011 |
| WO | 2012/083015 | | 6/2012 |
| WO | 2012/057790 | | 5/2013 |

OTHER PUBLICATIONS

PCT, International Search Report and Written Opinion, International Application No. PCT/US2012/025376 (Aug. 24, 2012).

(Continued)

*Primary Examiner* — Stephen Meier
*Assistant Examiner* — Alexander C Witkowski
(74) *Attorney, Agent, or Firm* — Thompson Hine L.L.P.

(57) ABSTRACT

An inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments, binder and a multivalent metal salt such that the inkjet recording medium exhibits improved inkjet print properties, particularly when printed with a high speed inkjet printer using pigmented inks.

11 Claims, No Drawings

(56) References Cited

U.S. PATENT DOCUMENTS

| | | | | |
|---|---|---|---|---|
| 2003/0064208 | A1 | 4/2003 | Yamada et al. | |
| 2003/0099816 | A1 | 5/2003 | Liu et al. | |
| 2003/0180478 | A1 | 9/2003 | Fruge et al. | |
| 2003/0191226 | A1 | 10/2003 | Chapman et al. | |
| 2003/0203133 | A1 | 10/2003 | Maekawa | |
| 2004/0080595 | A1 | 4/2004 | Taguchi et al. | |
| 2004/0189778 | A1 | 9/2004 | Stork et al. | |
| 2004/0255820 | A1 | 12/2004 | Chen et al. | |
| 2005/0003113 | A1 | 1/2005 | Chen et al. | |
| 2006/0054291 | A1 | 3/2006 | Dimmick et al. | |
| 2006/0060317 | A1 | 3/2006 | Roding et al. | |
| 2006/0061641 | A1* | 3/2006 | Ueki et al. | 347/101 |
| 2006/0098066 | A1 | 5/2006 | Bauer | |
| 2006/0099408 | A1 | 5/2006 | Andersson et al. | |
| 2006/0102304 | A1 | 5/2006 | Nutbeem et al. | |
| 2006/0112855 | A1 | 6/2006 | Andersson et al. | |
| 2006/0137574 | A1 | 6/2006 | Preston et al. | |
| 2006/0139406 | A1* | 6/2006 | Tsuchiya et al. | 347/54 |
| 2006/0159910 | A1 | 7/2006 | Song et al. | |
| 2006/0272549 | A1 | 12/2006 | Mathur et al. | |
| 2006/0292305 | A1 | 12/2006 | Skuse et al. | |
| 2007/0237909 | A1 | 10/2007 | McManus | |
| 2008/0008846 | A1 | 1/2008 | Zhou et al. | |
| 2008/0032074 | A1 | 2/2008 | Doi et al. | |
| 2008/0268185 | A1 | 10/2008 | Chen et al. | |
| 2009/0035478 | A1 | 2/2009 | Zhou et al. | |
| 2009/0074995 | A1 | 3/2009 | Dannhauser et al. | |
| 2009/0087568 | A1 | 4/2009 | Kobayashi | |
| 2009/0123675 | A1 | 5/2009 | Shaw-Klein et al. | |
| 2009/0131570 | A1 | 5/2009 | Schliesman et al. | |
| 2009/0169455 | A1 | 7/2009 | Van Aert et al. | |
| 2009/0203643 | A1 | 8/2009 | Patel | |
| 2011/0037818 | A1 | 2/2011 | Romano, Jr. et al. | |
| 2011/0050827 | A1 | 3/2011 | Romano, Jr. et al. | |
| 2011/0052818 | A1 | 3/2011 | Osterberg et al. | |
| 2011/0069106 | A1* | 3/2011 | Song et al. | 347/20 |
| 2011/0104406 | A1 | 5/2011 | Zhou et al. | |
| 2011/0279554 | A1 | 11/2011 | Dannhauser et al. | |
| 2012/0034398 | A1 | 2/2012 | Wang et al. | |
| 2012/0154502 | A1 | 6/2012 | Romano, Jr. et al. | |

OTHER PUBLICATIONS

Dimmick, A.C., "Effects of Sheet Moisture and Calender Pressure on PCC and GCC Coated Papers," TAPPI Journal (Nov. 2007).

Hugener, P. et al., "A New Coating Ground Calcium Carbonate for Enhanced Paper Properties" (Apr. 26, 2010).

Lee, D.I. et al., "Development of New Biobased Emulsion Binders," presented at TAPPI PaperCon 2010, Talent, Technology and Transformation, Atlanta, GA (May 2-5, 2010).

Press Release, Kodak Focuses on Delivering Offset Class Quality, Providing Scaleable Solutions with Inkjet Printing Systems (Jan. 17, 2008).

Product Information, "Hydrafine® Kaolin Clay," KaMin Performance Minerals (2009).

Product Information, "Hydragloss® 90 Kaolin Clay," KaMin Performance Minerals (2009).

Product Information, "Sylojet® C30 Cationic Porous Silica Dispersion for Ink Jet and Other Functional Coatings," W.R. Grace & Co. (Mar. 26, 2009).

Svanholm, "An Experimental Study of Inkjet Receptive Coatings" (Nov. 15, 2004).

Svanholm, Eric., "Printability and Ink-Coating Interactions in Inkjet Printing", Faculty of Technology and Science Chemical Engineering, Dissertation, Karlstad University Studies, 2007:2.

Wilson, I., "Filler and Coating Pigments and Papermakers," Industrial Minerals & Rocks: Commodities, Markets, and uses, 7th Edition, pp. 1287-1300 (2006).

"Formulation Guide for EcoSphere® Biolatex Binders," by EcoSynthetix Inc. (2010).

"Technical Data Sheet. EcoSphere® 2240 bioltex® binder for coated paper and paperboard," by EcoSynthetix Inc. (2010).

"Handling Options for EcoSphere® Biolatex® Binders," by EcoSynthetix (date of first publication unknown).

* cited by examiner

GLOSSY RECORDING MEDIUM FOR INKJET PRINTING

CROSS REFERENCE TO RELATED APPLICATIONS

The present application claims the benefit of U.S. Provisional Application No. 61/444,498 filed on Feb. 18, 2011, U.S. Provisional Application No. 61/470,810 filed on Apr. 1, 2011, and U.S. Provisional Application No. 61/567,181 filed on Dec. 6, 2011, the contents of which are hereby incorporated by reference.

BACKGROUND

The present application relates to an inkjet recording medium and a coating composition for forming an inkjet recording medium. More specifically, the inkjet coating composition disclosed herein contains a multivalent salt and the resulting recording medium is particularly useful for high speed multi-color printing such as high speed inkjet printing.

Traditionally, commercial printing presses printed catalogs, brochures and direct mail using offset printing. However, advances in inkjet technology have led to increased penetration into commercial print shops. Inkjet technology provides a high-quality alternative to offset printing for improving response rates, reducing cost, and increasing demand for products. In addition to printing high quality variable images and text, these printers incorporate a roll-fed paper transport system that enables fast, high-volume printing. Inkjet technology is now being used for on-demand production of local magazines, newspapers, small-lot printing, textbooks, and transactional printing world wide.

Continuous inkjet systems are being developed that enable offset class quality, productivity, reliability and cost with the full benefits of digital printing for high volume commercial applications. These systems allow continuous inkjet printing to expand beyond the core base of transactional printers and secondary imprinting and into high volume commercial applications. Kodak's PROSPER Inkjet technology is one example of such a system.

In accordance with certain aspects of the present invention, a recording medium is described which provides fast drying times, high gloss and excellent image quality when printed using high speed inkjet devices used in commercial printing applications.

U.S. Pat. No. 7,803,224 entitled "Paper and Coating Medium for Multifunction Printing" (Schliesman, et al.) discloses an inkjet recording medium that is compatible with offset, inkjet, and laser printing. While the disclosed formulation works well with many commercial inkjet printers, it performs poorly with the KODAK PROSPER printer. The contents of the '224 patent are hereby incorporated by reference.

SUMMARY

The present application describes an inkjet recording medium and a coating composition for forming an inkjet recording medium. In accordance with one aspect of the present invention, a glossy inkjet recording medium is disclosed comprising an inkjet-receptive coating on a paper substrate. The inkjet-receptive coating contains a synergistic combination of pigments, binder and a multivalent salt such that the inkjet recording medium exhibits improved inkjet print properties, particularly when printed with a high speed inkjet printer using pigmented or dye based inks.

In accordance with certain embodiments, the paper coating includes a combination of a primary pigment and a secondary pigment. The primary pigment typically includes fine particles having an average particle size of less than 1 micron. The secondary pigment may be a coarse pigment having an average particle size of about 2 to 5 microns. The coating also includes a binder and, optionally, a co-binder. Typically, a multi-valent salt is also included in the coating composition.

Fine calcium carbonate is particularly useful as the primary pigment. Fine calcium carbonate provides high brightness, gloss and opacity.

Another embodiment relates to a coated sheet that includes a paper substrate to which the above coating has been applied. The coated sheet is highly absorbent for many types of ink. It quickly absorbs ink from several passes of an inkjet printer.

The coating and coated paper of the instant invention are particularly useful with both dye and pigmented ink jet inks.

Another aspect of the present invention relates to a method of printing comprising depositing an inkjet ink on a coated substrate as described herein. In accordance with certain aspects, the inkjet ink is deposited from an inkjet printer and the inkjet ink includes at least one pigment-based colorant in an aqueous composition.

DETAILED DESCRIPTION

The coating for producing the inkjet recording medium typically includes at least two pigments, a primary pigment and a secondary pigment. The primary pigment may be a fine particle size pigment, such as calcium carbonate. The secondary pigment may be a coarse pigment. The primary and secondary pigments typically are inorganic pigments. Further, the coating typically includes a binder and, optionally, a co-binder. Pigments typically comprise the largest portion of the coating composition on a dry weight basis. Unless otherwise noted, amounts of component materials are expressed in terms of component parts per 100 parts of total pigment on a weight basis.

The primary component of the coating may be a fine pigment having an average particle size (d50) of less than 1 micron, more particularly from about 0.4 to 0.8 and still more particularly from about 0.5 to 0.8 microns. In accordance with certain embodiments, the primary pigment may have a particle size distribution with a d98 of about 0.7 to 5 microns, more particularly about 2 to 3.5 microns. The one micron percentage may be about 60 to 80%, more particularly about 35 to 75%. Primary pigments that are particularly useful may have a BET surface area in the range from about 5-20, more particularly about 8-12 $m^2/g$. In accordance with certain embodiments, the primary pigment may be at least 35 parts, more particularly from about 40 to about 90 parts, and still more particularly from about 45 to about 85 parts, per 100 parts total pigment by weight. A combination of pigments may be utilized in providing the primary pigment of the composition.

A particularly useful fine ground calcium carbonate is COVERCARB® HP available from OMYA AG, Oftringen, Switzerland. COVERCARB® HP typically has an average particle size of from about 0.4 to about 0.8 microns. HYDROCARB® 90 is an example of another commercially available pigment that can serve as the primary pigment in the present application.

The secondary pigment typically is a pigment larger in size than the primary pigment. The average particle size of the secondary pigment typically has an average particle size of about 2 to 5 microns, more particularly about 2.5 to 4 microns. In accordance with certain embodiments, the secondary pigment may have a particle size distribution with a d98 of about 10 to 20 microns, more particularly about 12 to 17 microns. The one micron percentage may be about 10 to 30%, more particularly about 15 to 25%. Secondary pigments that are particularly useful may have a BET surface area in the range from about 2-4 more particularly about 2.5-3.5 $m^2/g$. Amounts of the secondary pigment are typically no more than about 50 parts based on 100 parts by weight of the total pigment. The secondary pigment may be present in amounts greater than 5 parts pigment per 100 total parts pigment. In accordance with certain embodiments, the secondary pigment may be present in amounts from about 5-30 parts, more particularly from about 8-12 parts. In accordance with other embodiments, the secondary pigment may be present in amounts from about 5-55 parts, more particularly from about 10-50 parts. Examples of secondary pigments include carbonates, silicates, silicas, titanium dioxide, aluminum oxides and aluminum trihydrates. Particularly useful secondary pigments include coarse ground calcium carbonate, such as CARBITAL® 35 (Imerys, Roswell, Ga.) and HYDROCARB® PG-3. As with the primary pigment, the secondary pigment may comprise more than one pigment or type of pigment.

In accordance with certain embodiments, the average (median) particle size of the secondary pigment is about 4 to 6, more particularly about 5 times the average particle size of the primary pigment.

Supplemental pigments are optional and may include pigments used in the formulation as needed to improve gloss, whiteness or other coating properties. In accordance with certain embodiments, up to an additional 20 parts by weight of the dry coating pigment may be a supplemental pigment. Up to 15 parts, more particularly less than 10 parts, of the pigment may be a supplemental pigment, such as another carbonate pigment, plastic pigment, $TiO_2$, or mixtures thereof. Another supplemental pigment is anionic titanium dioxide, such as that available from Itochu Chemicals America (White Plains, N.Y.). Hollow spheres are particularly useful plastic pigments for paper glossing. Examples of hollow sphere pigments include ROPAQUE 1353 and ROPAQUE AF-1055 (Rohm & Haas, Philadelphia, Pa.). Higher gloss papers are obtainable when fine pigments are used that have a small particle size. The relative amounts of the supplemental pigments may be varied depending on the whiteness and desired gloss levels. Plastic pigments useful in accordance with certain aspects of the present invention have a void volume of about 40-70%, an average (median) particle size of about 0.9-1.4 microns and a glass transition temperature (Tg) of about 90°-110° C.

A primary binder is added to the coating for adhesion. The primary binder is compatible with the incorporation of a multivalent salt. In accordance with certain embodiments, the binder may be a biopolymer such as a starch or protein. In accordance with particularly useful embodiments, the polymer may comprise biopolymer particles, more particularly biopolymer microparticles and in accordance with certain embodiments, biopolymer nanoparticles. In accordance with particularly useful aspects, the biopolymer particles comprise starch particles and, more particularly, starch nanoparticles having an average particle size of less than 400 nm. Compositions containing a biopolymer latex conjugate comprising a biopolymer-additive complex reacted with a crosslinking agent as described in WO 2010/065750 are particularly useful. Biopolymer-based binders and, in particular, those binders containing biopolymer particles have been found to be compatible with the inclusion of a multivalent salt in the coating formulation and facilitate coating production and processing. For example, in some cases coating compositions can be prepared at high solids while maintaining acceptable viscosity for the coating composition. Biopolymer binders that may find use in the present application are disclosed in U.S. Pat. Nos. 6,677,386; 6,825,252; 6,921,430; 7,285,586; and 7,452,592, and WO 2010/065750, the relevant disclosure in each of these documents is hereby incorporated by reference. One example of a suitable binder containing biopolymer nanoparticles is Ecosphere® 2240 available from Ecosynthetix Inc.

The binder may also be a synthetic polymeric binder. In accordance with certain embodiments, the binder is compatible with the incorporation of a multivalent salt. The binder may be a non-ionic synthetic latex or it may be an anionic synthetic latex, such as styrene-butadiene, that has been rendered stable to formulations or coatings containing multivalent salts. These binders that would otherwise be incompatible with the presence of multi-valent salts may be modified to render them compatible through various modifications such as through the use of particular surfactants. In some embodiments, the binder may be a mixture of synthetic polymeric latex binder and natural latex binder (biopolymer). In accordance with particularly useful blends, the synthetic binder may account for at least 50% of the total binder by weight, more particularly at least about 75% and in certain cases at least about 90%. One example of a particularly useful combination of binders is Ecosphere®2240 available from Ecosynthetix Inc. and XL-2800 (anionic SBR latex available from OMNOVA Solutions Inc.). Compositions containing about 25% to 50% Ecosphere by weight based on total binder weight are particularly useful.

The total amount of primary binder typically is from about 2 to about 15, more particularly about 5 to about 13, parts per 100 parts of total pigments. In accordance with certain embodiments, a binder containing biopolymer particles may be the only binder in the coating composition.

The coating may also include a co-binder that is used in addition to the primary binder. Examples of useful co-binders include polyvinyl alcohol and protein binders. The co-binder, when present, typically is used in amounts of about 1 to about 10 parts co-binder per 100 parts of pigment on a dry weight basis, more particularly from about 2 to 7 parts co-binder per 100 parts dry pigment. Another co-binder that is useful in some embodiments is starch. Both cationic and anionic starches may be used as a co-binder. ADM Clineo 716 starch is an ethylated cornstarch (Archer Daniels Midland, Clinton, Iowa). Penford PG 260 is an example of another starch co-binder that can be used. In accordance with some embodiments, the coating is substantially free (for example, no more than 0.2 parts) of any SBR latex binder that is not calcium stable. The binder levels should be carefully controlled. If too little binder is used, the coating structure may lack physical integrity, while if too much binder is used, the coating may become less porous resulting in longer ink drying times.

The coating composition also includes a multivalent salt. In certain embodiments of the invention, the multivalent metal is a divalent or trivalent cation. More particularly, the multivalent metal salt may be a cation selected from $Mg^{+2}$, $Ca^{+2}$, $Ba^{+2}$, $Zn^{+2}$, and $Al^{+3}$, in combination with suitable counter ions. Divalent cations such as $Ca^{+2}$ and $Mg^{+2}$ are particularly useful. Combinations of cations may also be used.

Specific examples of the salt used in the coating include (but are not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly useful salts include $CaCl_2$, $MgCl_2$, $MgSO_4$, $Ca(NO_3)_2$, and $Mg(NO_3)_2$, including hydrated versions of these salts. Combinations of the salts may also be used. The salt may be present in the coating in an amount of about 2.5 to 15 parts, more particularly about 3 to 10 parts by weight based per 100 total parts of pigment.

A water retention aid may also be included in the coating to improve water retention. Coatings containing multivalent ions can lack sufficient water holding capability for commercial applications. In addition to increasing water retention, a secondary advantage is that it unexpectedly enhances the binding strength of the biopolymer. Tape pulls indicate better strength in coating formulations including a retention aid. Examples of water retention aids for use herein include, but are not limited to, polyethylene oxide, hydroxyethyl cellulose, polyvinyl alcohol, starches, and other commercially available products sold for such applications. One specific example of a suitable retention aid is Natrasol GR (Aqualon). In accordance with certain embodiments, the water retention aid may be present in an amount of about 0.1 to 2 parts, more particularly about 0.2 to 1 part per 100 parts of total pigments.

Other optional additives may be used to vary properties of the coating. Brightening agents, such as Clariant T26 Optical Brightening Agent, (Clariant Corporation, McHenry, Ill.) can be used. Insolubilizers or cross-linkers may be useful. A particularly useful cross-linker is Sequarez 755 (RohmNova, Akron, Ohio). Colored dyes can be added to adjust the tint. A lubricant is optionally added to reduce drag when the coating is applied with a blade coater. Diglyceride lubricants are particularly useful in accordance with certain embodiments. These optional additives, when present, are typically present in an amount of about 0.1 to 5 parts, more particularly about 0.2 to 2 parts per 100 parts of total pigments.

Coating compositions produced in accordance with certain aspects of the present invention involve a synergistic combination of components to provide the desired imaging and printing qualities as well as providing a coating composition that can be properly mixed, pumped and coated. Accordingly, the coating composition may be obtained by balancing particle size of pigments, inorganic pigment level, and level of plastic pigment to provide a coating composition capable of being calendered to produce a coated paper with a 75 degree gloss of about 50-75, more particularly of about 55-70. Although the present application is primarily directed to high gloss coatings, the coatings and coating conditions can be modified to produce dull or low gloss grades. For example, reducing the plastic pigment and increasing the amount of coarse carbonate can result in a coating suitable for producing a dull grade paper with a gloss of about 25-40, more particularly about 30-35.

To facilitate handling and coating of the formulation, it may be beneficial to maintain the Brookfield viscosity (90° F./20 RPM) of the formulation at less than about 12000 cps, more particularly less than about 10000 cps and in still other cases less than about 5000 cps. In accordance with certain aspects, the viscosity may be between about 2500 to 4500 cps. Coating compositions that are shear stable are particularly useful. Shear stable coatings exhibit little or no increase in viscosity when subjected to significant shear. Shear stability can be measured by subjecting a coating to shear in a mixer such as an Eppenbach at the highest shear setting that does not result in air entrainment and then measuring the viscosity of the coating as compared to a control composition that was not subjected to high shear. Dispersants can be a factor in the shear stability of a coating composition.

In accordance with certain embodiments, it may be beneficial to maintain the percent solids of the coating at a level greater than about 35%, typically greater than 40%, in some cases greater than about 50%, and in still other cases greater than about 55%. Coating compositions having high solids content in the range of about 55-65% can be particularly useful. Producing a coating formulation meeting these properties is even more difficult because of the presence of the salt in the formulation which can interact with other components of the formulation to increase the viscosity to a point where coating is compromised.

In accordance with some aspects, the coating composition may contain a dispersant that enables the composition to be formulated at a high solids content and yet maintain an acceptable viscosity. However, due to the particular components utilized to prepare the high solids coatings, typically used dispersants may not be suitable because they may lead to unacceptable viscosities. Dispersants, when included in the formulation, are typically used in amounts of about 0.2-2 parts, more particularly about 0.5-1.5 parts per 100 parts of total pigments. Dispersants that have been found to be suitable for this particular application of the coating composition include dispersants containing polymers with pigment affinic groups, polyether polycarboxylate salts and polyoxyalkylene salts. Specific examples include, without limitation, the following:

| Product Name | Manufacturer | Chemical Nature |
|---|---|---|
| BYK-190 | BYK USA | Solution of a high molecular weight block copolymer with pigment affinic groups |
| BYK-2010 | BYK USA | Acrylate copolymer with pigment affinic groups |
| XP1838 | Coatex | Polyether polycarboxylate, sodium salt in aqueous solution |
| Cartosperse K-XP228 | Lubrizol | Polyoxyalkylene sodium salt |

Examples of other useful dispersants include Disperbyk-199 (solution of a co-polymer with pigment affinic groups), Disperbyk-2015 (acrylate copolymer with pigment affinic groups) and Anti-Terra 250 (solution of an alkylammonium salt of a high molecular weight acidic polymer), all manufactured by BYK.

Conventional mixing techniques may be used in making this coating. If starch is used, it typically is cooked prior to preparing the coating using a starch cooker. In accordance with certain embodiments, the starch may be made down to approximately 35% solids. Separately, all of the pigments, including the primary pigment, secondary and any supplemental pigments, may be mixed for several minutes to ensure no settling has occurred. In the laboratory, the pigments may be mixed on a drill press mixer using a paddle mixer. The primary binder is then added to the mixer, followed by the co-binder 1-2 minutes later. If starch is used, it is typically added to the mixer while it is still warm from the cooker, approximately 190° F. The final coating is made by dispersion of the mixed components in water. Solids content of the dispersion typically is from about 35% to about 60% by weight. More particularly, the solids may be about 45% to about 58% of the dispersion by weight.

Yet another embodiment relates to an improved printing paper having a paper substrate to which the coating has been applied on at least one surface. Any coating method or apparatus may be used, including, but not limited to, roll coaters, jet coaters, blade coaters or rod coaters. The coating weight is typically about 2 to about 10, more particularly about 5 to about 9, pounds per 3300 ft.$^2$ per side, to size press, precoated, sized or unsized base papers. Coated papers would typically range from about 30 lb. to about 250 lb./3300 ft.$^2$ of paper surface. The coated paper is then optionally super calendered using conventional methods to the desired gloss. In accordance with certain aspects of the present invention, the finished paper has a 75° gloss value of at least 55%, more particularly between about 58% to 75%. Gloss may be measured in accordance with TAPPI standard, "Specular gloss of paper and paperboard at 75 degrees," Test Method T 480 om-09.

The substrate or base sheet may be a conventional base paper used in conventional offset grades. The basis weight/caliper may range from about 60# Text to 9 pt. In accordance with certain aspects of the present invention, the base sheet may have one or more of the following properties: Sheffield smoothness of less than 230, more particularly from about 80-150, a Gurley porosity of about 10-20 seconds, an MK Formation Test value of greater than 50 and a basestock density of greater than 13 lbs/caliper pt. for a ream size of 3,300 ft$^2$.

The finished coated paper is useful for printing Ink is applied to the coating to create an image. After application, the ink vehicle penetrates the coating and is absorbed therein. The number and uniformity of the coating pores result in even and rapid ink absorption, even when multiple layers of ink are applied. This coated paper may also be well suited for multifunctional printing, whereby an image on a coated paper media is created from combinations of dyes or pigmented inks from ink jet printers, toner from laser printers and inks from gravure or flexo presses.

Another aspect of the present application relates to a method of printing in which the above-described inkjet recording medium is printed with an inkjet printer. In accordance with certain embodiments, the printer employs at least one pigment-based colorant in an aqueous ink composition. The pigment-based colorants may be stabilized using anionic dispersants. Such dispersants can be polymeric, containing repeating sub-units, or may be monomeric in nature. The printing method may employ a continuous high-speed commercial inkjet printer, for example, in which the printer applies colored images from at least two different print heads, preferably full-width printheads with respect to the media, in sequence in which the different colored parts of the images are registered.

One type of printing technology, commonly referred to as "continuous stream" or "continuous" inkjet printing, uses a pressurized ink source that produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter, etc.) and either recycled or disposed of When print is desired, the ink droplets are not deflected and allowed to strike a print medium. Alternatively, deflected ink droplets may be allowed to strike the print media, while non-deflected ink droplets are collected in the ink capturing mechanism.

Typically, continuous inkjet printing devices are faster than droplet on demand devices and produce higher quality printed images and graphics. However, each color printed requires an individual droplet formation, deflection, and capturing system. Examples of conventional continuous inkjet printers are described in U.S. Pat. No. 1,941,001 issued to Hansell on Dec. 26, 1933; U.S. Pat. No. 3,373,437 issued to Sweet et al. on Mar. 12, 1968; U.S. Pat. No. 3,416,153 issued to Hertz et al. on Oct. 6, 1963; U.S. Pat. No. 3,878,519 issued to Eaton on Apr. 15, 1975; and U.S. Pat. No. 4,346,387 issued to Hertz on Aug. 24, 1982. Another type of continuous stream inkjet printer is disclosed in U.S. Pat. No. 6,554,410 to Jeanmaire, et al. The apparatus includes an ink-drop-forming mechanism operable to selectively create a stream of ink droplets having a plurality of volumes. Additionally, a droplet deflector having a gas source is positioned at an angle with respect to the stream of ink droplets and is operable to interact with the stream of droplets in order to separate droplets having one volume from ink droplets having other volumes. One stream of ink droplets is directed to strike a print medium and the other is directed to an ink catcher mechanism. The contents of the above-identified patents are hereby incorporated by reference.

The following non-limiting examples illustrate specific aspects of the present invention.

The formulations below were coated on 80# base paper manufactured at the NewPage, Wickliffe, Ky. mill by means of a blade coater at 6.5 lbs (per 3,300 ft.$^2$). The base paper used for this example typically contains a mixture of softwood and hardwood fibers. Softwood fibers typically are present in an amount of about 0-25% and hardwood fibers are present in an amount of about 100-75%. In accordance with a particularly useful base paper, the softwood and hardwood fibers are present in a ratio of 15% to 85%, respectively. The base paper typically includes from about 40-50 lb/ton size press starch and in particular embodiments about 45 lb/ton size press starch.

The ink jet receptive coatings were coated on a bench top blade coating applicator and calendered at 1200 PLI/100° F. using 3 nips/side. A test target was printed on the resulting paper with a Kodak 5300 printer containing standard Kodak pigmented inks A cyan or black Dmax patch was measured for mottle using a Personal IAS Image Analysis System manufactured by QEA. Mottle is a density non-uniformity that occurs at a low spatial frequency (i.e. noise at a coarse scale). A lower mottle value indicates better performance.

Table 1 provides non-limiting ranges for various components of an inkjet coating formulation in accordance with certain aspects of the present invention.

TABLE 1

Non-limiting Coating Formulation Ranges

| Generic Material | Broad Range Dry Parts | Narrow Range Dry Parts | Example Material |
|---|---|---|---|
| Secondary Pigment | 5-60 | 10-50 | Coarse Ground Carbonate |
| Primary Binder | 2-15 | 5-13 | Natural Latex Binder e.g., Ecosphere |
| Co-binder | 1-10 | 2-5 | Starch |
| Salt | 2.5-15 | 3-10 | Calcium Chloride |
| Supplemental Pigment | 0-20 | 5-15 | Plastic Pigment e.g., Ropaque AF-1353 |
| Primary Pigment | 40-90 | 45-85 | Fine Ground Carbonate |
| Crosslinker | 0-1 | 0.25-0.7 | Sequarez 755 |
| Lubricant | 0-1 | 0.4-0.8 | Berchem 4113 |
| Dispersant | 0-2 | 0.5-1.5 | Coatex XP 1838 |

Table 2 provides a representative formulation in accordance with a particular aspect of the present invention. The formulation provides excellent dry time and image quality when printed with a Kodak 5300 printer. This printer simulates the performance observed with Kodak high speed PROSPER printer.

TABLE 2

| Generic Material | Dry Parts | Example Material |
|---|---|---|
| Secondary Pigment | 9.5 | PG-3 Coarse Ground Carbonate |
| Primary Binder | 7.5 | Ecosphere Natural Latex Binder |
| Co-binder | 2 | Starch |
| Salt | 5 | Calcium Chloride |
| Supplemental Pigment | 10.5 | Ropaque AF-1353 Plastic Pigment |
| Primary Pigment | 80 | Covercarb HP Fine Ground Carbonate |
| Crosslinker | 0.5 | Sequarez 755 |
| Lubricant | 0.65 | Berchem 4113 |

Various coating compositions were prepared and coated on a bench top blade coating applicator. The coat weight target was 6.5# C2S applied to 80# Wickliffe Base. Samples with viscosities over 10,000 cps were not coated. Samples were tested with respect to solids, pH, Brookfield @20 rpm, Hercules @4400 rpm, and AA-GWR. The coated samples were treated under the following supering conditions: 1200 PLI, 25 FPM, 100° F., 3 nips/side.

The results are provided below in Table 3. The data shows that there is a delicate balance between the ratio of coating pigment, manufacturability, and gloss. If the level of plastic pigment is too high, high gloss can be obtained, but the viscosity is too high rendering the coating uncoatable. If the level of plastic pigment is too low, the viscosity can be reduced, but the gloss is too low. Of the three pigments, the course carbonate has the least interaction with the salt. By incorporating coarse carbonate, good gloss can be obtained while reducing the viscosity.

TABLE 3

Table 3A

| | | Support/ID 80# Wickliffe Base 5P8L22103A | | | | | |
|---|---|---|---|---|---|---|---|
| | | Coating Formulations | | | | | |
| | | A Dry Parts | B Dry Parts | C Dry Parts | D Dry Parts | E Dry Parts | F Dry Parts |
| Covercarb HP | | 90 | 80 | 70 | 60 | 80 | 80 |
| CC35 | | 10 | | 20 | 20 | 20 | 10 |
| AF-1353 | | | 20 | 10 | 20 | | 10 |
| EcoSphere | | 7.5 | 7.5 | 7.5 | 7.5 | 7.5 | 7.5 |
| PG260 | | 2 | 2 | 2 | 2 | 2 | 2 |
| CaCl2 | | 5 | 5 | 5 | 5 | 5 | 5 |
| Sequarez 755 | | 0.5 | 0.5 | 0.5 | 0.5 | 0.5 | 0.5 |
| Berchem 4113 | | 0.65 | 0.65 | 0.65 | 0.65 | 0.65 | 0.65 |
| Coat Weight (C1S) lbs. | | 6.9 | — | 6.8 | — | 6.9 | — |
| % Solids | | 46.9 | 47.0 | 46.9 | 47.2 | 47.1 | 46.9 |
| pH | | 5.9 | 6.0 | 6.0 | 6.0 | 5.9 | 6.0 |
| Brookfield Visc. (cps) | | | | | | | |
| @ 90° F./20 RPM | | 3450 | 17000 | 5450 | 11200 | 3200 | 6250 |
| Spindle | | 4 | 6 | 4 | 5 | 4 | 4 |
| Hercules "EE" Bob @ 4400 RPM | | | | | | | |
| App. Visc. (cps.) | | 27.7 | 95.2 | 44.7 | 82.8 | 27.3 | 46.8 |
| 75° Gloss | W | 46 | | 64 | — | 40 | — |
| Kodak Print Quality | W | Good | | Good | — | Good | — |
| Cyan Mottle | W | 0.79 | | 0.84 | | 0.70 | |

Table 3B

| | Coating Formulations | | | | | |
|---|---|---|---|---|---|---|
| | G Dry Parts | H Dry Parts | I Dry Parts | J Dry Parts | K Dry Parts | L Dry Parts |
| Covercarb HP | 80 | 80 | 90 | 70 | 60 | 100 |
| CC35 | | 10 | | 10 | 20 | |
| AF-1353 | 20 | 10 | 10 | 20 | 20 | |
| EcoSphere | 7.5 | 7.5 | 7.5 | 7.5 | 7.5 | 7.5 |
| PG260 | 2 | 2 | 2 | 2 | 2 | 2 |
| CaCl2 | 5 | 5 | 5 | 5 | 5 | 5 |
| Sequarez 755 | 0.5 | 0.5 | 0.5 | 0.5 | 0.5 | 0.5 |
| Berchem 4113 | 0.65 | 0.65 | 0.65 | 0.65 | 0.65 | 0.65 |
| Coat Weight (C1S) lbs. | — | 6.9 | 6.9 | — | — | 6.8 |
| % Solids | 47.1 | 47.2 | 47.2 | 47.0 | 47.2 | 47.2 |
| pH | 6.0 | 6.1 | 6.0 | 6.0 | 6.0 | 6.0 |
| Brookfield Visc. (cps) | | | | | | |
| @ 90° F./20 RPM | 17000 | 6410 | 8000 | 14000 | 14000 | 4050 |
| Spindle | 6 | 4 | 4 | 6 | 6 | 4 |

TABLE 3-continued

| | | | | | | | |
|---|---|---|---|---|---|---|---|
| Hercules "EE" Bob @ 4400 RPM | | | | | | | |
| App. Visc. (cps.) | | 102.0 | 49.0 | 51.7 | 92.0 | 94.1 | 29.1 |
| 75° Gloss | W | — | 67 | 68 | — | — | 45 |
| Kodak Print Quality | W | — | Good | Good | — | — | Good |
| Cyan Mottle | W | | 0.92 | 1.05 | | | 0.81 |

The effects of pigment ratios were evaluated by preparing compositions containing different ratios of three pigments and measuring viscosity (Brookfield viscosity at 90° F.) as set forth in Table 4.

TABLE 4

| Summary of Data From Tables 3A and 3B | | | | | | |
|---|---|---|---|---|---|---|
| | Covercarb HP | Coarse carb | AF-1353 | Viscosity (cps) | Gloss | Cyan Mottle |
| | 90 | 10 | 0 | 3450 | 46.18 | 0.79 |
| | 80 | 0 | 20 | 17000 | | |
| | 70 | 20 | 10 | 5450 | 64.09 | 0.84 |
| | 60 | 20 | 20 | 11200 | | |
| | 80 | 20 | 0 | 3200 | 39.86 | 0.70 |
| | 80 | 10 | 10 | 6250 | | |
| | 80 | 0 | 20 | 17000 | | |
| | 80 | 10 | 10 | 6410 | 67.22 | 0.92 |
| | 90 | 0 | 10 | 8000 | 67.61 | 1.05 |
| | 70 | 10 | 20 | 14000 | | |
| | 60 | 20 | 20 | 14000 | | |
| | 100 | 0 | 0 | 4050 | 45.3 | 0.81 |
| 80# Sterling Ultra Gloss Text | | | | | 73.0 | 3.03 |

Sterling Ultra Gloss has no salt and consequently has very poor image quality.

Various coating compositions were prepared and coated on a bench top blade coating applicator using an increased amount of secondary pigment. The coat weight target was 6.5# C1S applied to 80# Wickliffe Base. Samples were tested with respect to solids, pH, Brookfield @20 rpm, Hercules @4400 rpm, and AA-GWR. The coated samples were treated under the following supering conditions: 1200 PLI, 25 FPM, 100° F., 3 nips/side. The results are provided below in Table 5.

TABLE 5

| Table 5A: | | | | | | |
|---|---|---|---|---|---|---|
| | | Coating Formulations | | | | |
| | | 118 Dry Parts | 119 Dry Parts | 120 Dry Parts | 121 Dry Parts | 122 Dry Parts |
| Covercarb HP | | 60.25 | 65.25 | 52.5 | 72.5 | 58 |
| CC35 | | 30.5 | 25.5 | 40 | 20 | 31 |
| AF-1353 | | 9.25 | 9.25 | 7.5 | 7.5 | 11 |
| EcoSphere | | 7.5 | 7.5 | 7.5 | 7.5 | 7.5 |
| PG260 | | 2 | 2 | 2 | 2 | 2 |
| CaCl2 | | 5 | 5 | 5 | 5 | 5 |
| Sequarez 755 | | 0.5 | 0.5 | 0.5 | 0.5 | 0.5 |
| Berchem 4113 | | 0.65 | 0.65 | 0.65 | 0.65 | 0.65 |
| Coat Weight (C1S) lbs. | | 6.5 | 6.4 | 6.5 | 6.3 | 6.4 |
| % Solids | | 47.1 | 47.2 | 47.0 | 47.2 | 46.9 |
| pH | | 6.2 | 6.2 | 6.2 | 6.3 | 5.9 |
| Brookfield Visc. (cps) | | | | | | |
| @ 90° F./20 RPM | | 4800 | 4950 | 3650 | 4750 | 5000 |
| Spindle | | 4 | 4 | 4 | 4 | 4 |
| Hercules "EE" Bob @ 4400 RPM | | | | | | |
| App. Visc. (cps.) | | 30.7 | 39.1 | 37.7 | 37.0 | 477 |
| 75° Gloss | W | 54 | 56 | 50 | 54 | 63 |
| Kodak Print Quality | W | Good | Good | Good | Good | Good |
| Cyan Mottle | W | 1.10 | 0.68 | 0.83 | 0.86 | 0.82 |

TABLE 5-continued

Table 5B:

| | | Coating Formulations | | | | |
|---|---|---|---|---|---|---|
| | | 123 Dry Parts | 124 Dry Parts | 125 Dry Parts | 126 Dry Parts | 80# Sterling Ultra Gloss Text |
| Covercarb HP | | 65 | 50 | 65 | 50 | |
| CC35 | | 20 | 35 | 20 | 40 | |
| AF-1353 | | 15 | 15 | 15 | 10 | |
| EcoSphere | | 7.5 | 7.5 | 7.5 | 7.5 | |
| PG260 | | 2 | 2 | 2 | 2 | |
| CaCl2 | | 5 | 5 | 5 | 5 | |
| Sequarez 755 | | 0.5 | 0.5 | 0.5 | 0.5 | |
| Berchem 4113 | | 0.65 | 0.65 | 0.65 | 0.65 | |
| Coat Weight (C1S) lbs. | | 6.7 | 6.5 | 6.6 | 6.5 | |
| % Solids | | 47.0 | 47.2 | 47.2 | 46.9 | |
| pH | | 5.9 | 5.9 | 5.9 | 6.0 | |
| Brookfield Visc. (cps) | | | | | | |
| @ 90° F./20 RPM | | 7920 | 6550 | 8150 | 3900 | |
| Spindle | | 4 | 4 | 4 | 4 | |
| Hercules "EE" Bob @ 4400 RPM | | | | | | |
| App. Visc. (cps.) | | 61.8 | 59.8 | 61.4 | 39.8 | |
| 75° Gloss | W | 72 | 71 | 72 | 61 | |
| Kodak Print Quality | W | Good | Good | Good | Good | Poor |
| Cyan Mottle | W | 0.75 | 0.71 | 0.71 | 0.73 | |

The effects of pigment ratios were evaluated by preparing compositions containing different ratios of three pigments and measuring viscosity (Brookfield viscosity at 90° F.) as set forth in Table 6.

TABLE 6

Summary of Data From Tables 5A and 5B

| Covercarb HP | Coarse carb | AF-1353 | Viscosity | Gloss | Black Mottle |
|---|---|---|---|---|---|
| 60.25 | 30.5 | 9.25 | 4800 | 53.91 | 2.824 |
| 65.25 | 25.5 | 9.25 | 4950 | 55.58 | 2.643 |
| 52.5 | 40 | 7.5 | 3650 | 49.68 | 2.699 |
| 72.5 | 20 | 7.5 | 4750 | 54.22 | 2.537 |

TABLE 6-continued

Summary of Data From Tables 5A and 5B

| Covercarb HP | Coarse carb | AF-1353 | Viscosity | Gloss | Black Mottle |
|---|---|---|---|---|---|
| 58 | 31 | 11 | 5000 | 63.05 | 2.671 |
| 65 | 20 | 15 | 7920 | 71.92 | 2.463 |
| 50 | 35 | 15 | 6550 | 70.62 | 2.557 |
| 65 | 20 | 15 | 8150 | 71.95 | 2.203 |
| 50 | 40 | 10 | 3900 | 60.8 | 2.719 |

The effects of incorporating a dispersant into the formulation were evaluated by preparing compositions containing different dispersants and measuring viscosity (Brookfield viscosity at 90° F.) as set forth in Tables 7 and 8.

TABLE 7

| | Coating Formulations | | | | | |
|---|---|---|---|---|---|---|
| | Control—No Dispersant Dry Parts | Control—Standard Dispersant Dry Parts | Inventive Example 7-1 Dry Parts | Inventive Example 7-2 Dry Parts | Inventive Example 7-3 Dry Parts | Inventive Example 7-4 Dry Parts |
| Covercarb HP | 50 | 50 | 50 | 50 | 50 | 50 |
| CGC | 39.5 | 39.5 | 39.5 | 39.5 | 39.5 | 39.5 |
| EcoSphere 2240 | 7.5 | 7.5 | 7.5 | 7.5 | 7.5 | 7.5 |
| PG260 | 2 | 2 | 2 | 2 | 2 | 2 |
| Dispex N-40 | | 0.75 | | | | |
| Carbosperse K-XP228 | | | 0.75 | | | |
| DisperBYK-190 | | | | 0.75 | | |
| DisperBYK-2010 | | | | | 0.75 | |
| XP1838 | | | | | | 0.75 |
| CaCl2 | 5 | 5 | 5 | 5 | 5 | 5 |
| AF-1353 | 10.5 | 10.5 | 10.5 | 10.5 | 10.5 | 10.5 |
| Sequarez 755 | 0.5 | 0.5 | 0.5 | 0.5 | 0.5 | 0.5 |
| Berchem 4113 | 0.65 | 0.65 | 0.65 | 0.65 | 0.65 | 0.65 |
| % Solids | 59.5 | 59.8 | 59.2 | 59.0 | 59.0 | 59.2 |
| Brookfield Visc. (cps) | | | | | | |
| @ 90° F./20 RPM | 48250 | 88000 | 8000 | 10300 | 11100 | 6800 |
| Spindle | 6 | 7 | 4 | 5 | 5 | 4 |

TABLE 7-continued

| | Coating Formulations | | | | | |
|---|---|---|---|---|---|---|
| | Control—No Dispersant Dry Parts | Control—Standard Dispersant Dry Parts | Inventive Example 7-1 Dry Parts | Inventive Example 7-2 Dry Parts | Inventive Example 7-3 Dry Parts | Inventive Example 7-4 Dry Parts |
| Brookfield Visc. After Eppenbach (30 min) | | | | | | |
| @ 90° F./20 RPM | | | 12200 | 9600 | 9400 | 8300 |
| Spindle | | | 5 | 5 | 5 | 4 |

As illustrated in Table 7, high solids compositions without a dispersant or with a standard dispersant (Dispex N-40, Sodium salt of an acrylic polymer, BASF) exhibit unacceptably high viscosities that render the compositions unsuitable for conventional coating operations. Compositions containing the dispersants as described herein exhibit acceptable viscosities and are suitable for conventional coating operations. Shear stability provides some indication of the suitability of a coating composition for typical coating operations. Shear stability can be measured by subjecting the coating to shear in an Eppenbach mixer (30 minutes at maximum shear without air entrainment (typically at a shear rate of about 3,000 to 30,000, more particularly about 8,000 to 25,000 and still more particularly about 9,000 to 12,000 $s^{-1}$)) and then measuring the viscosity. Preferably, the viscosity of the coating composition after being subjected to high shear is within about 35%, more particularly about 25% and still more particularly about 10% of the initial viscosity. Coating compositions that exhibit viscosities after shear that are significantly different from the starting viscosities may not be shear stable and may result in production issues. The compositions set forth in examples 7-1 to 7-4 exhibited acceptable viscosity after being subjected to high shear and are considered to be shear stable. Particularly useful dispersants include those that provide lower Brookfield viscosities while exhibiting minimal change in viscosity after shear is applied.

TABLE 8

| | Coating Formulations | | |
|---|---|---|---|
| | 8-1 Dry Parts | 8-2 Dry Parts | 8-3 Dry Parts |
| Covercarb HP | 50 | 50 | 50 |
| CGC | 39.5 | 39.5 | 39.5 |
| EcoSphere 2202 | 7.5 | 7.5 | 7.5 |
| PG260 | 2 | 2 | 2 |
| DisperBYK-199 | 1 | | |
| DisperBYK-2015 | | 1 | |
| Anti-Terra 250 | | | 1 |
| Sequarez 755 | 0.75 | 0.75 | 0.75 |
| CaCl2 | 5 | 5 | 5 |
| AF-1353 | 10.5 | 10.5 | 10.5 |
| Berchem 4113 | 0.65 | 0.65 | 0.65 |
| % Solids | 58.4 | 58.5 | 58.5 |
| pH | 5.63 | 5.59 | 5.7 |
| Brookfield Visc. | | | |
| @ 90° F./20 RPM | 9000 | 7000 | 8500 |
| Spindle | 5 | 5 | 5 |
| Brookfield Viscosity After Eppenbach (30 min) | | | |
| @ 90° F./20 RPM | 7900 | 7400 | 9000 |
| Spindle | 5 | 5 | 5 |

As illustrated in Table 8, high solids compositions containing the dispersants set forth in these examples exhibited acceptable viscosities and shear stability. Accordingly, these compositions would be suitable for conventional coating operations. In some cases, it may be desirable to reduce the solids content of the coatings to lower the viscosity of the coating to a range that is suitable for a particular coating operation.

While this invention has been described in detail with reference to certain embodiments, it should be appreciated that the present invention is not limited to those precise embodiments. Rather, in view of the present disclosure, many modifications and variations would present themselves to those skilled in the art without departing from the scope and spirit of this invention.

What is claimed is:

1. A method of printing comprising:

providing an inkjet recording medium comprising:

a paper substrate; and an inkjet-receptive coating comprising a primary pigment having an average particle size of less than 1 microns;

a secondary pigment having an average particle size of 3 to 5 microns;

a multivalent salt; and a binder wherein said binder is compatible with the multivalent salt and present in an amount from about 2 to 15 parts by weight of based on 100 parts total pigments; and applying an inkjet ink to said inkjet recording medium wherein said ink comprises an aqueous ink composition comprising a pigment-based colorant.

2. An inkjet recording medium comprising:

a paper substrate; and an inkjet-receptive coating comprising a primary pigment having an average particle size of less than 1 microns;

a secondary pigment having an average particle size of 3 to 5 microns;

a multivalent salt;

a binder wherein said binder is compatible with the multivalent salt and present in an amount from about 2 to 15 parts by weight of based on 100 parts total pigments;

wherein said binder comprises a natural latex binder comprising starch nanoparticles having an average particle size of less than 400 nm; or a biopolymer latex conjugate comprising a biopolymer-additive complex reacted with a crosslinking agent.

3. The inkjet recording medium of claim 2 wherein said binder comprises a stabilized anionic synthetic styrene butadiene latex binder.

4. The inkjet recording medium of claim 2 wherein the multivalent metal salt is selected from the group consisting of calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, aluminum nitrate and mixtures thereof.

5. The inkjet recording medium of claim 4 wherein the multivalent metal salt comprises calcium chloride.

6. An inkjet recording medium comprising:

a paper substrate; and an inkjet-receptive coating comprising a primary pigment having an average particle size of less than 1 microns;

a secondary pigment having an average particle size of 3 to 5 microns;

a multivalent salt;

a binder wherein said binder is compatible with the multivalent salt and present in an amount from about 2 to 15 parts by weight of based on 100 parts total pigments; and a plastic pigment present in an amount of about 5 to 15 parts per 100 parts total pigments.

7. An inkjet recording medium comprising:

a paper substrate; and an inkjet-receptive coating comprising a primary pigment having an average particle size of less than 1 microns;

a secondary pigment having an average particle size of 3 to 5 microns;

a multivalent salt;

a binder wherein said binder is compatible with the multivalent salt and present in an amount from about 2 to 15 parts by weight of based on 100 parts total pigments; and a dispersant selected from the group consisting of dispersants containing polymers with pigment affinic groups, polyether polycarboxylate salts and polyoxyalkylene salts.

8. An inkjet recording medium comprising:

a paper substrate; and an inkjet-receptive coating comprising a primary pigment having an average particle size of less than 1 microns;

a secondary pigment having an average particle size of 3 to 5 microns;

a multivalent salt;

a binder wherein said binder is compatible with the multivalent salt and present in an amount from about 2 to 15 parts by weight of based on 100 parts total pigments; and wherein the inkjet recording medium has a TAPPI 75° gloss of about 25 to 40% or 55 to 75%.

9. The inkjet recording medium of claim 8 wherein each of said primary and secondary pigments comprises calcium carbonate.

10. The inkjet recording medium of claim 8 wherein said coating comprises a blend of a synthetic latex binder and a natural latex binder.

11. An inkjet-receptive coating composition comprising:

a primary pigment having an average particle size of less than 1 microns;

a secondary pigment having an average particle size of 3 to 5 microns;

a multivalent salt; and a binder wherein said binder is present in an amount from about 2 to 15 parts by weight of based on 100 parts total pigments; and a dispersant selected from the group consisting of dispersants containing polymers with pigment affinic groups, polyether polycarboxylate salts and polyoxyalkylene salts.

* * * * *